US005328820A

United States Patent [19]

Klaus et al.

[11] Patent Number: 5,328,820

[45] Date of Patent: Jul. 12, 1994

[54] SILVER HALIDE PHOTOGRAPHIC EMULSIONS SENSITIZED IN THE PRESENCE OF ORGANIC DISULFIDES AND SULFINATES

[75] Inventors: Roger L. Klaus, Rochester; Patricia A. Leonard, Brockport, both of N.Y.

[73] Assignee: Eastman Kodak Company, Rochester, N.Y.

[21] Appl. No.: 978,539

[22] Filed: Nov. 19, 1992

[51] Int. Cl.[5] ..... G03C 1/34

[52] U.S. Cl. ..... 430/569; 430/567; 430/607; 430/611; 430/613; 430/614

[58] Field of Search ..... 430/607, 608, 611, 567, 430/569, 613, 614

[56] References Cited

U.S. PATENT DOCUMENTS 2,385,762 9/1945 Mueller .
2,438,716 3/1948 Mueller .
2,440,110 4/1948 Mueller .
3,397,986 8/1968 Millikan et al. .
5,110,719 5/1992 Shuto et al. ..... 430/607
5,217,859 6/1993 Boettcher et al. ..... 430/569
5,219,721 6/1993 Klaus et al. ..... 430/569

*Primary Examiner*—Charles L. Bowers, Jr.
*Assistant Examiner*—Mark F. Huff
*Attorney, Agent, or Firm*—Sarah M. Roberts

[57] ABSTRACT

This invention provides a method of preparing a silver halide photographic emulsion which comprises adding to the silver halide emulsion after precipitation and before or during sensitization a disulfide compound and a sulfinate compound, wherein the disulfide compound and the sulfinate compound are added simultaneously. It further provides a silver halide photographic emulsion prepared by the above method.

24 Claims, No Drawings

SILVER HALIDE PHOTOGRAPHIC EMULSIONS SENSITIZED IN THE PRESENCE OF ORGANIC DISULFIDES AND SULFINATES

FIELD OF THE INVENTION

The present invention relates to light sensitive silver halide emulsions. In particular, it relates to light sensitive silver halide emulsions sensitized in the presence of organic disulfides and sulfinates.

BACKGROUND OF THE INVENTION

Problems with fogging have plagued the photographic industry from its inception. Fog is a deposit of silver or dye that is not directly related to the image-forming exposure, e.g., when a developer acts upon an emulsion layer, some reduced silver is formed in areas that have not been exposed to light. Fog can be defined as a developed density that is not associated with the action of the image-forming exposure, and is usually expressed as "Dmin", the density obtained in the unexposed portions of the emulsion. A density, as normally measured, includes both that produced by fog and that produced by exposure to light. It is known in the art that the appearance of photographic fog related to intentional or unintentional reduction of silver ion (reduction sensitization) can occur during many stages of preparation of the photographic element including silver halide emulsion preparation, (spectral) chemical sensitization of the silver halide emulsion, melting and holding of the liquid silver halide emulsion melts, subsequent coating of silver halide emulsions, and prolonged natural and artificial aging of coated silver halide emulsions.

The use of sulfinic acids and seleninic acids and their alkali cation salts in silver halide emulsions as antifoggants and storage stabilizers was first described by Brunken in U.S. Pat. No. 2,057,764. It appears as though the effect seen was due to the action of sulfinates or seleninates on sulfur-containing impurities in gelatin to diminish the amount of fresh fog and fog after incubation attributed to formation of silver sulfide. Later patents which discuss sulfinates and seleninates relate to their beneficial combination effect with a limited class of disulfides, such as those of Mueller in U.S. Pat. Nos. 2,385,762; 2,438,716; 2,440,110. Mueller teaches adding both the disulfide and sulfinate after chemical sensitization to affect fresh antifogging and storage stability.

U.S. Pat. No. 3,397,986 discloses bis(p-acylamidophenyl) disulfides as useful antifoggants added before or after any optically sensitizing dyes. U.S. Pat. No. 5,219,721 discloses the addition of dichalcogenides, including bis(p-acylamidophenyl) disulfides, to a silver halide emulsion before or during chemical sensitization.

There is a continuing need for improved methods of preventing fog in photographic elements without severely impacting sensitivity.

SUMMARY OF THE INVENTION

This invention provides a method of making a photographic silver halide emulsion comprising:

precipitating and sensitizing a silver halide emulsion and simultaneously adding to the silver halide emulsion after precipitation and before or during spectral/chemical sensitization an antifogging amount of a disulfide compound represented by Formula I or II and an antifogging amount of a sulfinate or seleninate compound represented by Formula III:

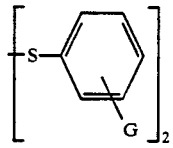

(Formula I)

where

G independently is hydrogen, hydroxy, $-SO_3M$, or $-NR^1R^2$;

M is hydrogen, or an alkaline earth, alkylammonium, or arylammonium cation;

$R^1$ is hydrogen, or a substituted or unsubstituted alkyl, or aryl group;

$R^2$ is hydrogen, $O{=}C{-}R^3$, or $O{=}C{-}N{-}R^4R^5$; and $R^3$, $R^4$, and $R^5$ are independently hydrogen, or hydroxy, or an unsubstituted alkyl, or aryl group, or a fluoroalkyl, fluoroaryl, alkylthioether, or arylthioether group, or a carboxyalkyl, carboxyaryl, sulfoalkyl, or sulfoaryl group or the free acid, alkaline earth salt or alkylammonium or arylammonium salt thereof;

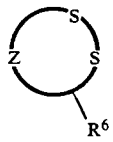

(Formula II)

where Z is a group containing 3 to 10 carbon or hetero atoms; and $R^6$ is an alkyl or aryl group of 2 to 10 carbon atoms, or the free acid, alkaline earth salt, arylammonium or alkylammonium salt of the aforementioned groups; and $R^7{-}XO_2{-}M$ (Formula III)

where $R^7$ is an aliphatic, aromatic, or heterocyclic group; X is sulfur or selenium; and M is a cation.

In one embodiment, the disulfide compound and the sulfinate or seleninate compound are combined in an aqueous/methanol solution and then added to the emulsion.

It has been found that when certain disulfide compounds and a sulfinate/seleninate compound are added simultaneously to a silver halide emulsion immediately before or during (spectral) chemical sensitization, that the emulsion has lower fog and less loss in sensitivity than when alternative methods of addition of the disulfide and sulfinate/seleninate compounds are used. It has further been found that less latent image destabilization occurs and that less loss in sensitivity occurs after aging of the coated emulsions.

DETAILED DESCRIPTION OF THE INVENTION

The disulfide compounds of this invention are represented by Formula I or II.

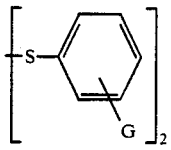

(Formula I)

In Formula I, G is independently in any position in the aromatic nucleus relative to the sulfur. More preferably, the molecule is symmetrical and most preferably G is in the para position. G is hydrogen, hydroxy, $-SO_3M$ or $-NR^1R^2$. More preferably, G is $-NR^1R^2$.

M is hydrogen, or an alkaline earth, alkylammonium or arylammonium cation. Preferably, M is hydrogen or sodium, and more preferably, M is sodium. $R^1$ is hydrogen, or a substituted or unsubstituted alkyl or aryl group. Preferred substituents on the alkyl or aryl groups of $R^1$ may be methyl, amino, carboxy, or combinations thereof. The preferred groups contain up to 20, and more preferably, up to 10 carbon atoms. Examples of suitable groups are trifluoromethyl, methyl, ethyl, propyl, phenyl, and tolyl.

$R^2$ is hydrogen, $O{=}C{-}R^3$, or $O{=}C{-}N{-}R^4R^5$. More preferably, $R^2$ is hydrogen, or $O{=}C{-}R^3$.

$R^3$, $R^4$, and $R^5$ are independently hydrogen, or hydroxy, or an unsubstituted alkyl, or aryl group, or a substituted or unsubstituted fluoroalkyl, fluoroaryl, alkylthioether, or arylthioether group, or a substituted or unsubstituted carboxyalkyl, carboxyaryl, sulfoalkyl, or sulfoaryl group or the free acid, alkaline earth salt or alkylammonium or arylammonium salt of the carboxy or sulfo groups. Examples of suitable groups are trifluoromethyl, methyl, ethyl, n-butyl, isobutyl, phenyl, naphthyl, carboxymethyl, carboxypropyl, carboxyphenyl, oxalate, terephthalate, methylthiomethyl, and methylthioethyl.

In a more preferred embodiment, $R^1$ is a hydrogen or methyl and $R^2$ is $O{=}C{-}R^3$. $R^3$ is preferably an alkyl group of 1 to 10 carbon atoms, an aryl group of 6 to 10 carbon atoms or a trifluoromethyl group. Most preferably, the disulfide compound is p-acetamidophenyl disulfide.

Examples of preferred disulfide compounds are listed in Table 1.

TABLE I

| Examples of Formula I* Designation, Position, and Substituent Structure of G | | |
|---|---|---|
| I-1 | para | $N(H)C(O)CH_3$ |
| I-2 | meta | $N(H)C(O)CH_3$ |
| I-3 | ortho | $N(H)C(O)CH_3$ |
| I-4 | para | $NH_2$ x HCl |
| I-5 | para | N(H)C(O)H |
| I-6 | ortho | N(H)C(O)H |
| I-7 | para | $N(H)C(O)CF_3$ |
| I-8 | ortho | $N(H)C(O)CF_3$ |
| I-9 | para | N(H)C(O)-phenyl |
| I-10 | para | N(H)C(O)-ethyl |
| I-11 | para | N(H)C(O)-propyl |
| I-12 | para | N(H)C(O)-naphthyl |
| I-13 | para | $N(H)C(O)C_7H_{15}$ |
| I-14 | para | $N(H)C(O)C_{14}H_{29}$ |
| I-15 | para | $N(H)C(O)C_{17}H_{35}$ |
| I-16 | para | $N(H)C(O)CH_2{-}S{-}C_{12}H_{25}$ |
| I-17 | para | $N(H)C(O)CH_2{-}S{-}CH_3$ |
| I-18 | para | $N(H)C(O)C_2H_4{-}S{-}CH_3$ |
| I-19 | para | $N(H)C(O)CH_2(CH_3){-}S{-}CH_3$ |
| I-20 | para | N(H)C(O)-phenyl(2-$SO_3Na$) |
| I-21 | para | $N(H)C(O)C(CH_3)_3$ |

TABLE I-continued

| Examples of Formula I* Designation, Position, and Substituent Structure of G | | |
|---|---|---|
| I-22 | para | N(H)C(O)-phenyl(4-$CO_2CH_3$) |

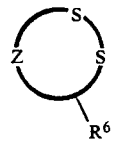

(Formula II)

In Formula II, Z contains 3 to 10 substituted or unsubstituted carbon or hetero atoms and forms a ring with the disulfide. The preferred hetero atom is nitrogen. Most preferably, Z contains all carbon atoms. Preferred substituents on Z may be, for example, methyl, ethyl, or phenyl groups. $R^6$ is a substituted or unsubstituted alkyl or aryl group of 2 to 10 carbon atoms, and more preferably, 4 to 8 carbon atoms, or the free acid, alkaline earth salt, or the alkylammonium or arylammonium salt of the aforementioned groups. Preferably, $R^6$ is a substituted or unsubstituted carboxyalkyl, carboxyaryl, alkyl ester, or aryl ester group. Examples of appropriate substituents include alkyl and aryl groups.

More preferably, Z comprises four carbon atoms and $R^6$ is an alkyl or carboxyalkyl group of 4 to 8 carbon atoms, or the free acid, alkaline earth salt or ammonium salt of the aforementioned groups. The most preferred disulfide compounds of general Formula II are 5-thioctic acid and 6-thioctic acid. Examples of Formula II are the following:

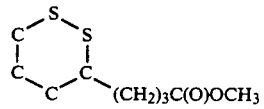

(II-1)

and

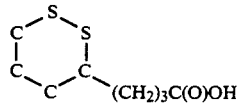

(II-2)

The disulfide compounds of this invention can be prepared by the various methods known to those skilled in the art.

The optimal amount of the disulfide compound to be added will depend on the desired final result, the type of emulsion, the degree of ripening, and other variables. In general, the concentration of disulfide which is adequate is from about $1\times10^{-9}$ to about $1\times10^{-2}$ mol/mol Ag, with $1\times10^{-7}$ to $1\times10^{-2}$ mol/mol Ag being preferred and about $1\times10^{-5}$ to $3\times10^{-4}$ mol/mol Ag being most preferred.

The disulfide compounds of this invention can be added to the photographic emulsion using any technique suitable for this purpose. They can be added from solutions or as solids. For example, they can be dissolved in a suitable water miscible solvent and added directly to the silver halide emulsion as described in U.S. Pat. No. 3,397,986 or they can be added to the emulsion in the form of a liquid/liquid dispersion similar to the technique used with certain couplers. Examples of suitable solvents or diluents include methanol, ethanol, or acetone.

They may also be added as a solid particle dispersion as described in U.S. Pat. No. 5,217,859.

The sulfinate or seleninate compounds of this invention are represented by Formula III below:

$$R^7—XO_2—M \qquad \text{Formula III}$$

where $R^7$ is a substituted or unsubstituted aliphatic, aromatic, or heterocyclic group; X is sulfur or selenium; and M is a cation. More preferably, X is sulfur.

When $R^7$ is an aliphatic group, preferably it is an alkyl group having from 1 to 22 carbon atoms, or an alkenyl or alkynyl group having from 2 to 22 carbon atoms. More preferably, it is an alkyl group having 1 to 8 carbon atoms, or an alkenyl or alkynyl group having 3 to 5 carbon atoms. These groups may or may not have substituents. Examples of alkyl groups include methyl, ethyl, propyl, butyl, pentyl, hexyl, octyl, 2-ethylhexyl, decyl, dodecyl hexadecyl, octadecyl, cyclohexyl, isopropyl and t-butyl groups. Examples of alkenyl groups include allyl and butenyl groups and examples of alkynyl groups include propargyl and butynyl groups.

The preferred aromatic group has from 6 to 20 carbon atoms and includes, among others, phenyl and naphthyl groups. More preferably, the aromatic group has 6 to 10 carbon atoms. These groups may have substituent groups. The heterocyclic group represented by $R^7$ is a 3 to 15 membered ring with at least one atom selected from nitrogen, oxygen, sulfur, selenium and tellurium. More preferably, the heterocyclic group is a 5 to 6 membered ring with at least one atom selected from nitrogen. Examples of heterocyclic groups include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings. Most preferably, $R^7$ is a substituted aromatic group having 6 to 10 carbon atoms.

Examples of substituent groups for $R^7$ include alkyl groups (for example, methyl, ethyl, hexyl), alkoxy groups (for example, methoxy, ethoxy, octyloxy), aryl groups (for example, phenyl, naphthyl, tolyl), hydroxyl groups, halogen atoms, aryloxy groups (for example, phenoxyl), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxyl groups, cyano groups, sulfo groups, and amino groups.

M is preferably a metal ion or an organic cation. Most preferably, M is an alkali metal ion. Examples of metal ions include lithium, sodium, or potassium. Examples of organic cations include ammonium ions (for example, ammonium, tetramethylammonium, tetrabutylammonium), phosphonium ions (for example, tetraphenylphosphonium), and guanidyl groups.

Specific examples of General Formula III include, but are not limited to:

$CH_3SO_2Na$ (III-1)

$C_2H_5SO_2Na$ (III-2)

$C_3H_7SO_2K$ (III-3)

-continued $C_4H_9SO_2Li$ (III-4)

$C_6H_{13}SO_2Na$ (III-5)

$C_8H_{17}SO_2Na$ (III-6)

$CH_3(CH_2)_3CH(C_2H_5)CH_2SO_2NH_4$ (III-7)

$C_{10}H_{21}SO_2Na$ (III-8)

$C_{12}H_{25}SO_2Na$ (III-9)

$C_{16}H_{33}SO_2Na$ (III-10)

$(CH_3)_3CH—SO_2K$ (III-11)

$(t)C_4H_9SO_2Na$ (III-12)

$CH_3OCH_2CH_2SO_2Na$ (III-13)

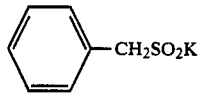

(III-14)

$CH_2=CHCH_2SO_2Na$ (III-15)

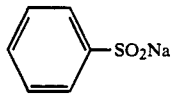

(III-16)

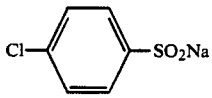

(III-17)

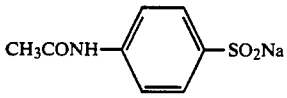

(III-18)

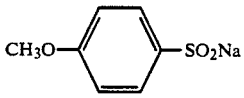

(III-19)

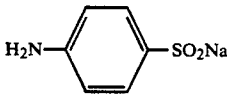

(III-20)

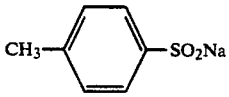

(III-21)

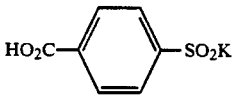

(III-22)

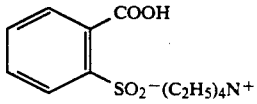

(III-23)

-continued (III-24)

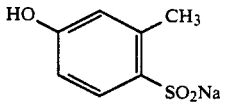

(III-25)

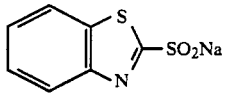

(III-26)

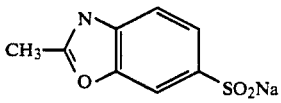

(III-27)

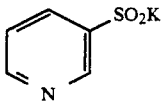

(III-28)

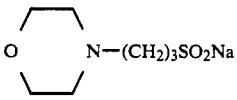

Further, examples include benzeneseleninic acid, ethaneseleninic acid, sodium benzeneseleninate, potassium chlorobenzenesulfinate, salicylicsulfinic acid, and benzoselenizole-2-sodium sulfinate. The most preferred sulfinate is sodium p-tolylsulfinate.

The sulfinate or seleninate compound may be added in any manner known in the art. For example, it can be added as a water solution of the free acid or alkaline earth salt. The amount which may be added ranges from about $2\times10^{-9}$ mol/mol Ag to about $5\times10^{-1}$ mol/mol Ag, with the preferred amount being from about $2\times10^{-5}$ mol/mol Ag to about $2\times10^{-2}$ mol/mol Ag.

Photographic emulsions are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are chemically and spectrally sensitized, as known in the art. Chemical sensitization of the emulsion employs sensitizers such as sulfur-containing compounds, e.g., allyl isothiocyanate, sodium thiosulfate and allyl thiourea; selenium-containing compounds, e.g., selenourea and selencyanate; reducing agents, e.g., polyamines and stannous salts; noble metal compounds, e.g., gold and platinum; and polymeric agents, e.g., polyalkylene oxides. A temperature rise is employed to complete chemical sensitization (heat treatment). Spectral sensitization is effected with agents such as sensitizing dyes. For color emulsions, dyes are added in the spectral sensitization step using any of a multitude of agents described in the art. It is known to add such dyes both before and after the heat treatment.

After spectral sensitization, the emulsion is coated on a support. Various coating techniques include dip coating, air knife coating, curtain coating and extrusion coating.

In this invention, the disulfide and sulfinate/seleninate compounds can be added anytime after precipitation and before or during the heat treatment employed to effect chemical sensitization. This time frame is referred to herein as spectral/chemical sensitization. The disulfide and sulfinate/seleninate compounds may be added before or after the addition of sensitizers but preferably before the sensitizers. They can be added from the beginning or part way through the sensitization process. In one embodiment, the emulsion is sensitized with sulfur and gold compounds as known in the art.

The sulfinate or seleninate compound and the disulfide compound should be added to the emulsion simultaneously, i.e., with no more than a few seconds between additions. Addition by this method produces the best balance of low fog with minimal loss in sensitivity. In the most preferred method, the disulfide compound and the sulfinate/seleninate compound are mixed to give an aqueous/methanol solution and are added to the emulsion together prior to sensitization.

Combinations of the disulfide compounds may be added, i.e., two or more of Formula I or Formula II compounds, or a combination of Formula I and II compounds. Combinations of the sulfinate/seleninate compounds may also be used. These compounds also may be added in combination with other antifoggants and finish modifiers.

The method of this invention is particularly useful with intentionally or unintentionally reduction sensitized emulsions. As described in *The Theory of the Photographic Process,* Fourth Edition, T. H. James, Macmillan Publishing Company, Inc., 1977, pages 151–152, reduction sensitization has been known to improve the photographic sensitivity of silver halide emulsions. Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion).

During precipitation of a silver halide emulsion, unintentional reduction sensitization can occur when silver nitrate or alkali solutions are added rapidly or with poor mixing to form emulsion grains, for example. Also, precipitation of silver halide emulsions in the presence of ripeners (grain growth modifiers) such as thioethers, selenoethers, thioureas, or ammonia tends to facilitate reduction sensitization.

The reduction sensitized silver halide emulsions prepared, as described in this invention, exhibit good photographic speed but usually suffer from undesirable fog and poor storage stability.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23,113 (1979).

Examples of processes for preparing intentionally reduction sensitized silver halide emulsions are described in EP 0 348934 A1 (Yamashita), EP 0 369491 (Yamashita), EP 0 371388 (Ohashi), EP 0 396424 A1 (Takada), EP 0 404142 A1 (Yamada), and EP 0 435355 A1 (Makino).

The method of this invention is also particularly useful with emulsions doped with Group VIII metals such as iridium, rhodium, osmium, and iron as described in *Research Disclosure,* Dec., 1989, Item 308119, published by Kenneth Mason Publications, Ltd., Dudley Annex, 12*a* North Street, Emsworth, Hampshire P010 7DQ, ENGLAND. It is common practice in the art to dope emulsions with these metals for reciprocity control.

A general summary of the use of iridium in the sensitization of silver halide emulsions is contained in Carroll, "Iridium Sensitization: A Literature Review," Photographic Science and Engineering, Vol. 24, No. 6, 1980.

A method of manufacturing a silver halide emulsion by chemically sensitizing the emulsion in the presence of an iridium salt and a photographic spectral sensitizing dye is described in U.S. Pat. No. 4,693,965. The low intensity reciprocity failure characteristics of a silver halide emulsion may be improved, without significant reduction of high intensity speed, by incorporating iridium ion into the silver halide grains after or toward the end of the precipitation of the grains. This is described in U.S. Pat. No. 4,997,751. The use of osmium in precipitating an emulsion is described in U.S. Pat. No. 4,933,272 (McDugle).

In some cases, when such dopants are incorporated, emulsions show an increased fresh fog and a lower contrast sensitometric curve when processed in the color reversal E-6 process as described in The British Journal of Photography Annual, 1982, pages 201-203.

The photographic elements of this invention can be non-chromogenic silver image forming elements. They can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore, U.S. Pat. No. 4,362,806 issued Dec. 7, 1982. The element can contain additional layers such as filter layers, interlayers, overcoat layers, subbing layers and the like.

In the following discussion of suitable materials for use in the emulsions and elements of this invention, reference will be made to *Research Disclosure,* Dec., 1989, Item 308119, published by Kenneth Mason Publications, Ltd., Dudley Annex, 12*a* North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of this invention can include various dye-forming couplers including, but not limited to, those described in Research Disclosure Section VII, paragraphs D, E, F, and G and the publications cited therein. These couplers can be incorporated in the elements and emulsions as described in Research Disclosure Section VII, paragraph C, and the publications cited therein.

The photographic elements of this invention or individual layers thereof can contain among other things brighteners (Examples in Research Disclosure Section V), antifoggants and stabilizers (Examples in Research Disclosure Section VI), antistain agents and image dye stabilizers (Examples in Research Disclosure Section VII, paragraphs I and J), light absorbing and scattering materials (Examples in Research Disclosure Section VIII), hardeners (Examples in Research Disclosure Section X), plasticizers and lubricants (Examples in Research Disclosure Section XII), antistatic agents (Examples in Research Disclosure Section XIII), matting agents (Examples in Research Disclosure Section XVI) and development modifiers (Examples in Research Disclosure Section XXI).

The photographic elements can be coated on a variety of supports including, but not limited to, those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image, examples of which are described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable, and then developed with a color developer. Additionally, the preceding process can be employed, but before uniformly fogging the emulsion, the remaining silver halide is dissolved and the developed silver is converted back to silver halide; the conventional E-6 process is then continued and results in a negative color image. Alternatively, a direct positive emulsion can be employed to obtain a positive image.

Development is followed by the conventional steps of bleaching, fixing, or bleach-fixing, to remove silver and silver halide, washing and drying.

The following examples are intended to illustrate, without limiting, this invention.

EXAMPLES

Example 1

The control emulsion was prepared as follows: A 0.56-μm×0.083-μm 4% iodide, silver bromoiodide tabular emulsion was sensitized with 0.185 g of sodium thiocyanate/mol Ag, 6.6 mg of sodium aurous dithiosulfate dihydrate/mol Ag, 6.2 mg sodium thiosulfate pentahydrate/mol Ag, 0.088 g anhydro-9-ethyl -5,5'-dimethyl(-3,3'-di(3-disulfopropyl) thiacarbocyanine hydroxide triethylamine salt/mol Ag and 0.88 g anhydro-9-ethyl-5,5'-dichloro-3,3'-bis-(2-hydroxy-3-sulfopropyl) thiacarbocyanine hydroxide sodium salt/mol Ag by holding at 61° C. for 15 minutes. The resulting sensitized emulsion was mixed with additional water and gelatin in preparation for coating. A secondary melt composed of gelatin, Hexanamide, 2-[2,4-bis(1,1-dimethylpropyl)phenoxy]-N-[4-[(2,2,3,3,4,4,4-heptafluoro-1-oxobutyl)amino]-3-hydroxyphenyl], and coating surfactants was mixed in equal volumes with the emulsion melt immediately before coating on a cellulose acetate support. This emulsion layer was then protected by a gelatin overcoat and hardened.

The resulting dried coatings containing 75 mg silver/ft$^2$, 220 mg gelatin/ft$^2$, and 144 mg Hexanamide, 2-[2,4-bis(1,1-dimethylpropyl)phenoxy]-N-[4-[(2,2,3,3,4,4,4-heptafluoro-1-oxobutyl)amino]-3-hydroxyphenyl]/ft$^2$ were exposed for 0.02 seconds through a stepped density tablet and 0.3 density Inconel and Kodak Wratten 23A filters with 5500K light. Exposed strips were then developed in either E-6 color reversal developer to obtain a positive color image or a black and white developer followed by forming a negative color image with a color reversal process as described previously.

Example 2

The control emulsion described in Example 1 was sensitized in the presence of p-acetamidophenyl disulfide, Compound I-1 (APD), sodium p-toluenesulfinate, Compound III-21 (STS), or combinations of APD and STS. The APD was added as a methanolic solution and the STS was added as an aqueous solution. The combinations of APD and STS were added by the following methods: the STS was added first, after two minutes the APD was added, both before the heat treatment (Addition I); APD was added before the heat treatment and STS was added after heat treatment (Addition II); or APD and STS were mixed to give an aqueous-methanol solution and added to the emulsion melt together before the heat treatment (Addition III). The emulsions were diluted with gelatin, water, and 4-hydroxy-6-methyl-1,3,3*a*,7-tetraazaindene and coated. The resulting coatings were dried and exposed before processing to give a negative color image.

| Condition | mg/mol Ag (APD/STS) | Relative Speed | Fog |
|---|---|---|---|
| Control | (0/0) | 100 | 0.605 |
| STS | (0/2400) | 89 | 0.629 |
| APD | (0.3/0) | 100 | 0.514 |
| APD | (0.8/0) | 102 | 0.518 |
| APD | (3.0/0) | 100 | 0.451 |
| APD | (33.0/0) | 39 | 0.049 |
| Addition I | (33.0/2400) | 5.7 | 1.782 |
| Addition II | (33.0/2400) | 44 | 0.065 |
| Addition III | (33.0/2400) | 94 | 0.216 |

These data show that by itself APD reduces fog without a loss in sensitivity when added at lower levels to the sensitization. STS by itself gives loss in sensitivity with higher fog contrary to U.S. Pat. No. 2,057,764. These results further show that there is a large dependence on order of addition of disulfide and sulfinate ranging from a drastic increase in fog and loss in sensitivity (Addition I) to a small loss in sensitivity with a significant decrease in fog (Addition II). When used in the correct combination (Addition III), lower fog and higher sensitivity results than when used individually.

While the invention has been described in detail and with reference to specific embodiments thereof, it will be apparent to one skilled in the art that various changes and modifications can be made therein without departing from the spirit and scope thereof.

What is claimed is:

1. A method of making a negative photographic silver halide emulsion comprising:

precipitating and sensitizing a silver halide emulsion; and simultaneously adding to the silver halide emulsion after precipitation and before or during spectral/chemical sensitization an antifogging amount of a disulfide compound represented by Formula I or II and an antifogging amount of a sulfinate or seleninate compound represented by Formula III:

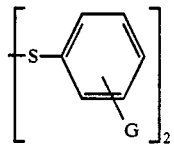

(Formula I)

where

G independently is hydrogen, hydroxy, —$SO_3M$ or —$NR^1R^2$;

M is hydrogen, or an alkaline earth, alkylammonium or arylammonium cation;

$R^1$ is hydrogen, or an alkyl or aryl group $R^2$ is hydrogen, O=C—$R^3$, or O=C—N—$R^4R^5$; and $R^3$, $R^4$, and $R^5$ are independently hydrogen, or hydroxy, or an unsubstituted alkyl, or aryl group, or a fluoroalkyl, fluoroaryl, alkylthioether, or arylthioether group, or a carboxyalkyl, carboxyaryl, alkylthioether, sulfoalkyl, or sulfoaryl group or the free acid, alkaline earth salt to alkylammonium or arylammonium salt thereof;

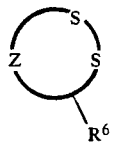

(Formula II)

where Z is a group containing 3 to 10 carbon or hetero atoms and $R^6$ is an alkyl or aryl group of 2 to 10 carbon atoms, or the free acid, alkaline earth salt, arylammonium or alkylammonium salt of the aforementioned groups; and $R^7$—$XO_2$—M Formula III where $R^7$ is a aliphatic, aromatic, or heterocyclic group; X is sulfur or selenium; and M is a cation.

2. The method of claim 1 wherein the disulfide is represented by Formula I, the molecule is symmetrical and G is —$NR^1R^2$; and $R^2$ is hydrogen or O=C—$R^3$; or wherein the disulfide compound is represented by Formula II and $R^6$ is a carboxyalkyl, carboxyaryl, alkyl ester, or aryl ester group of 2 to 10 carbon atoms, or the free acid, alkaline earth salt, arylammonium or alkylammonium salt of the aforementioned groups.

3. The method of claim 2 wherein G is in a para position relative to sulfur, $R^1$ is hydrogen or methyl, $R^2$ is O=C—$R^3$ and $R^3$ is an alkyl group of 1 to 10 carbon atoms, an aryl group of 6 to 10 carbon atoms or a trifluoromethyl group; or wherein Z comprises carbon atoms sufficient to form a ring and $R^6$ is an alkyl or aryl group of 4 to 8 carbon atoms, or the free acid, alkaline earth salt, arylammonium or alkylammonium salt of the aforementioned groups.

4. The method of claim 3 wherein the disulfide compound is p-acetamidophenyl disulfide.

5. The method of claim 3 wherein $R^6$ is a carboxyalkyl, carboxyaryl, alkyl ester, or aryl ester group of 4 to 8 carbon atoms, or the free acid, alkaline earth salt, arylammonium or alkylammonium salt of the aforementioned groups.

6. The method of claim 5 wherein the compound is 5-thioctic acid or 6-thioctic acid.

7. The method of claim 1 wherein the antifogging amount of the disulfide compound is $1\times10^{-7}$ to $1\times10^{-2}$ mol/mol Ag.

8. The method of claim 1 wherein the antifogging amount of the disulfide compound is $1\times10^{-5}$ to $3\times10^{-4}$ mol/mol Ag.

9. The method of claim 1 wherein $R^7$ is an alkyl group having from 1 to 22 carbon atoms; an alkenyl or alkynyl group having from 2 to 22 carbon atoms; an aromatic group having from 6 to 20 carbon atoms; or a heterocyclic group having 3 to 15 members with at least one atom selected from nitrogen, oxygen, sulfur, selenium and tellurium; and M is a metal ion or an organic cation.

10. The method of claim 1 wherein X is sulfur; $R^7$ is an alkyl group having from 1 to 8 carbon atoms; an alkenyl or alkynyl group having from 3 to 5 carbon atoms; an aromatic group having from 6 to 10 carbon atoms; or a heterocyclic group having a 5 to 6 membered ring with at least one atom selected from nitrogen, oxygen, sulfur, selenium and tellurium; and M is an alkali metal ion.

11. The method of claim 1 wherein X is sulfur; $R^7$ is a substituted aromatic group having 6 to 10 carbon atoms; and M is sodium, potassium, or lithium.

12. The method of claim 10 wherein the sulfinate compound is sodium p-tolylsulfinate.

13. The method of claim 1 wherein the antifogging amount of the sulfinate or seleninate compound is $2\times10^{-9}$ to 0.5 mol/mol Ag.

14. The method of claim 1 wherein the antifogging amount of the sulfinate or seleninate compound is $2\times10^{-5}$ to $2\times10^{-2}$ mol/mol Ag.

15. The method of claim 1 wherein the disulfide compound and the sulfinate or seleninate compound are combined in an aqueous/methanol solution and then added to the emulsion.

16. A method of making a negative photographic silver halide emulsion comprising:

precipitating and sensitizing a silver halide emulsion; and simultaneously adding to the emulsion after precipitation and before or during spectral/chemical sensitization $1\times10^{-7}$ to $1\times10^{-2}$ mol/mol Ag of a disulfide compound represented by Formula I and $2\times10^{-9}$ to 0.5 mol/mol Ag of a sulfinate compound represented by Formula III;

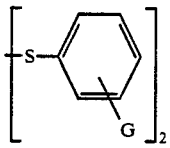

(Formula I)

wherein G is in a para position relative to sulfur and is —$NR^1R^2$, $R^1$ is hydrogen or methyl, $R^2$ is O=C—$R^3$ and $R^3$ is an alkyl group of 1 to 10 carbon atoms, an aryl group of 6 to 10 carbon atoms or a trifluoromethyl group; and $R^7$—$XO_2$—M Formula III wherein X is sulfur; $R^7$ is an alkyl group having from 1 to 8 carbon atoms; an alkenyl or alkynyl group having from 3 to 5 carbon atoms; an aromatic group having from 6 to 10 carbon atoms; or a heterocyclic group having a 5 to 10 membered ring with at least one atom selected from nitrogen, oxygen, sulfur, selenium and tellurium; and M is an alkali metal ion.

17. The method of claim 16 wherein the amount of disulfide compound added is $1\times10^{-5}$ to $3\times10^{-4}$ mol/mol Ag.

18. The method of claim 16 wherein the disulfide compound is p-acetamidophenyl disulfide.

19. The method of claim 16 wherein the amount of the sulfinate compound added is $2\times10^{-5}$ to $2\times10^{-2}$ mol/mol Ag.

20. The method of claim 16 wherein X is sulfur; $R^7$ is a substituted aromatic group having 6 to 10 carbon atoms; and M is sodium, potassium, or lithium.

21. The method of claim 16 wherein the sulfinate compound is sodium p-tolylsulfinate.

22. The method of claim 16 wherein the disulfide compound and the sulfinate compound are combined in an aqueous/methanol solution and then added to the emulsion.

23. A method of making a negative photographic silver halide emulsion comprising:

precipitating and sensitizing a silver halide emulsion; and combining $1\times10^{-5}$ to $3\times10^{-4}$ mol/mol Ag p-acetamidophenyl disulfide and $2\times10^{-5}$ to $2\times10^{-2}$ mol/mol Ag sodium p-tolylsulfinate in an aqueous/methanol solution; and adding the aqueous/methanol solution of p-acetamidophenyl disulfide and sodium p-tolylsulfinate to the emulsion after precipitation and before or during spectral/chemical sensitization.

24. A negative photographic silver halide emulsion prepared by any one of the methods described in claim 1 through 23.

* * * * *

IN THE UNITED STATES PATENT AND TRADEMARK OFFICE

CERTIFICATE OF CORRECTION

PATENT NO. : 5,328,820

DATED : July 12, 1994

INVENTOR(S) : Roger L. Klaus and Patricia A. Leonard

It is certified that errors appear in the above-identified patent and that said Letters Patent is hereby corrected as shown below:

Column 12, line 38, before "sulfoalkyl," insert --- arylthioether, ---.

Column 14, line 60, "claim" should read --- claims ---

Signed and Sealed this

First Day of November, 1994

Bruce Lehman

*Attest:*

BRUCE LEHMAN

*Attesting Officer*

*Commissioner of Patents and Trademarks*